US005699688A

United States Patent [19]

Allred

[11] Patent Number: 5,699,688

[45] Date of Patent: Dec. 23, 1997

[54] FEED CONTROL SYSTEM

[75] Inventor: Robert T. Allred, High Point, N.C.

[73] Assignee: Dynamic Feeds, Inc., High Point, N.C.

[21] Appl. No.: 550,712

[22] Filed: Oct. 31, 1995

[51] Int. Cl.[6] ..... B21D 43/11

[52] U.S. Cl. ..... 72/20.5; 72/421

[58] Field of Search ..... 72/20.5, 420, 421, 72/422; 226/158, 162, 150; 100/273

[56] References Cited

U.S. PATENT DOCUMENTS

| | | | |
|---|---|---|---|
| 3,009,508 | 11/1961 | Kelly | 226/158 |
| 3,416,392 | 12/1968 | Rutz | 100/273 |
| 3,863,823 | 2/1975 | Allred | 226/158 |
| 4,523,449 | 6/1985 | Moriyama et al. | 226/158 |
| 5,271,146 | 12/1993 | Kashiwagi | 140/105 |

*Primary Examiner*—Lowell A. Larson
*Attorney, Agent, or Firm*—Rhodes Coats & Bennett, L.L.P.

[57] ABSTRACT

A feed control system for a metal forming machine. The feed control system includes a feed assembly mounted on the metal forming machine. The feed assembly includes a slide assembly and a rotating ball-screw operatively connected to the slide assembly. The slide assembly is linearly movable in response to rotation of the ball-screw which is driven by a servo-motor. A control system is operatively connected to the feed assembly for automatically cycling the feed assembly in synchronization with the press so as to feed the metal stock into the press.

41 Claims, 6 Drawing Sheets

FEED CONTROL SYSTEM

BACKGROUND OF THE INVENTION (1) Field of the Invention

The present invention relates generally to feed mechanisms for metal forming machines and, more particularly, to a feed control system that includes a microprocessor-controlled servo-driven ball-screw drive and a pair of eccentric roller gripper assemblies for feeding stock into a metal forming machine.

(2) Description of the Prior Art

Metal forming machines have been commonly used for many years to stamp metal pieces out of wire or elongated flat strips of metal stock, typically fed from a spool or coil. For example, U.S. Pat. No. 4,043,234 to Godin et al. discloses an apparatus and method for cutting circles with a die press from sheet metal stock material fed from a supply roll. Typically, the metal stock first passes through a straightener and then is incrementally fed to a die cutter, stamper, or puncher, located beneath a cam-driven mechanical press, which cycles up and down to perform its selected function on the stock.

One significant disadvantage of conventionally designed metal forming machines lies in the design of the feed mechanism that incrementally advances then halts the metal stock as it is fed into the die press. Some feed mechanisms include press rollers or the like that turn in stops and starts to incrementally advance the stock. Other feed mechanisms use grippers that are driven back and forth by a piston or a cam disc and that grip the stock on the forward stroke, thereby incrementally advancing it. One problem with previously designed feed mechanisms is that they have always been troublesome and time-consuming to properly set up. When changing the feeding operation, it is typically necessary to manually loosen adjustment bolts, approximate the correct settings, retighten the adjustment bolts, rethread the stock into the feeder, run the feeder, then make additional adjustments as necessary. This trial and error method of adjusting the feed mechanism often causes significant delays when alterations are necessary in the middle of a particular metal forming operation or when the machine is being changed over to run a different metal forming operation.

Previously designed feed mechanisms also have been generally mechanically driven; that is, the feed mechanisms have been mechanically linked to the cycling press. Therefore, existing metal forming machines are often difficult to retrofit with a new feed mechanism. Because of the required integration of the press components with the feed mechanism components, compatibility may not be possible with new and different parts.

Thus, there remains a need for a new and improved feed control system that automatically and precisely feeds metal stock into a metal forming machine without requiring complicated, time consuming adjustments, while at the same time allowing easy, compatible retrofitting of existing metal forming machines.

SUMMARY OF THE INVENTION

The present invention is directed to a feed control system for a metal forming machine having a cycling press. The feed control system includes a feed assembly mounted on the metal forming machine to feed metal stock into the press. The feed assembly includes a slide assembly and a rotating ball-screw operatively connected to the slide assembly. The slide assembly is linearly movable in response to rotation of the ball-screw which is driven by a servo-motor. A control system is operatively connected to the metal forming machine for automatically synchronizing the feed assembly with the press.

In the preferred embodiment, the control system includes a microprocessor for controlling cycling of the feed apparatus and for synchronizing the cycling of the feed apparatus with the cycling of the press. The control system also includes a resolver interconnected between the ball-screw and the microprocessor for monitoring rotational position of the ball-screw and for communicating the rotational position of the ball-screw to the microprocessor. Finally, a feed control sensor is interconnected between the press and the microprocessor for communicating the position of the press in a press cycle to the microprocessor.

Also, in the preferred embodiment, a gripping apparatus is attached to the slide assembly for engaging and moving the metal stock into the press, wherein the gripping apparatus includes a roller gripper assembly including an eccentric roller head, an actuator, and a base plate mounted in a frame, the actuator adapted for moving the roller head towards the base plate to grip the metal stock therebetween.

Accordingly, one aspect of the present invention is to provide a feed control system for feeding metal stock into a press of a metal forming machine. The feed control system includes: (a) a feed assembly mounted on the metal forming machine and including: (i) a slide assembly, (ii) a rotating ball-screw operatively connected to the slide assembly, the slide assembly linearly movable in response to rotation of the ball-screw, and (iii) a servo-motor for driving the ball-screw; and (b) a microprocessor control system operatively connected to the feed assembly for automatically cycling the feed assembly in synchronization with the press so as to feed the metal stock into the press.

Another aspect of the present invention is to provide a control system for a metal forming machine having a cycling press and a cycling stock feeding mechanism, the stock feeding mechanism including a motor-driven screw assembly and a feed apparatus that is linearly movable in response to rotation of the screw assembly for engaging and feeding stock into the cycling press. The control system includes: (a) a microprocessor for controlling cycling of the feed apparatus and for synchronizing the cycling of the feed apparatus with the cycling of the press; (b) a resolver interconnected between the screw assembly and the microprocessor for monitoring rotational position of the screw assembly and for communicating the rotational position of the screw assembly to the microprocessor; and (c) a feed control sensor interconnected between the press and the microprocessor for communicating the position of the press in a press cycle to the microprocessor.

Still another aspect of the present invention is to provide a feed control system for feeding metal stock into a press of a metal forming machine. The feed control system includes: (a) a feed assembly mounted on the metal forming machine and including: (i) a slide assembly, (ii) a rotating ball-screw operatively connected to the slide assembly, the slide assembly linearly movable in response to rotation of the ball-screw, and (iii) a servo-motor for driving the ball-screw; and (b) a control system operatively connected to the feed assembly for automatically cycling the feed assembly in synchronization with the press so as to feed the metal stock into the press, the control system including: (i) a microprocessor for controlling cycling of the feed apparatus and for synchronizing the cycling of the feed apparatus with the cycling of the press; (ii) a resolver interconnected between the ball-screw and the microprocessor for monitoring rotational position of the ball-screw and for communicating the rotational position of the ball-screw to the microprocessor; and (iii) a feed control sensor interconnected between the press and the microprocessor for communicating the position of the press in a press cycle to the microprocessor; and (c) a gripping apparatus attached to the slide assembly for engaging and moving the metal stock into the press, wherein the gripping apparatus includes a roller gripper assembly including a roller head, an actuator, and a base plate mounted in a frame, the actuator adapted for moving the roller head towards the base plate to grip the metal stock therebetween.

These and other aspects of the present invention will become apparent to those skilled in the art after a reading of the following description of the preferred embodiment when considered with the drawings.

DESCRIPTION OF THE PREFERRED EMBODIMENTS

Figure 1:
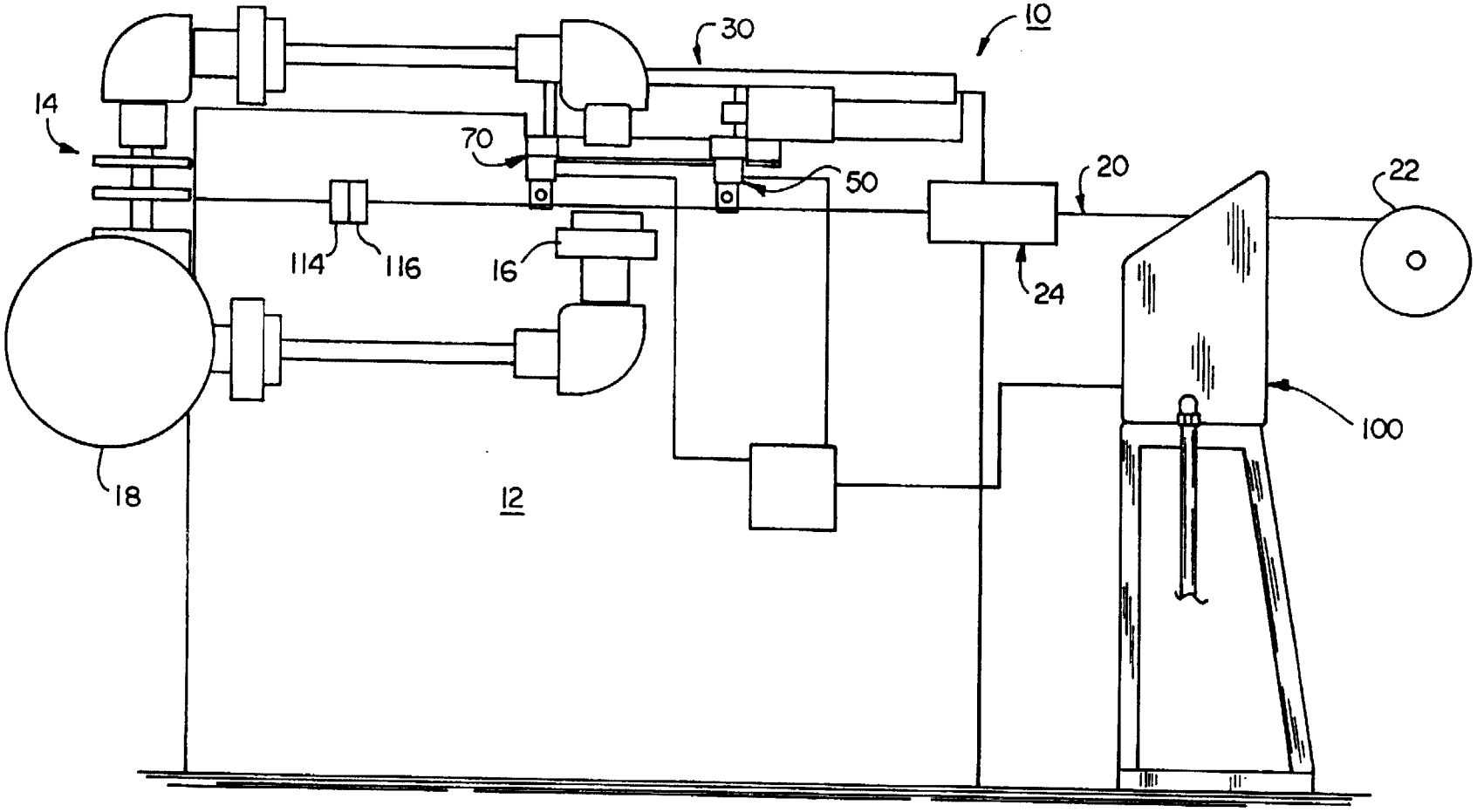
FIG. 1 is a front view of a conventional metal forming machine fitted with a feed control system constructed accordingly to the present invention.

In the following description, like reference characters designate like or corresponding parts throughout the several views. Also in the following description, it is to be understood that such terms as "forward", "rearward", "left", "right", "upwardly", "downwardly", and the like are words of convenience and are not to be construed as limiting terms.

Referring now to the drawings in general and FIG. 1 in particular, it will be understood that the illustrations are for the purpose of describing a preferred embodiment of the invention and are not intended to limit the invention thereto. As best seen in FIG. 1, a feed control system, generally designated 10, is shown constructed according to the present invention and mounted on a conventional metal forming machine 12. The feed control system 10 includes three major sub-assemblies: a feed assembly 30; a gripping apparatus 40; and a microprocessor control system 100.

The feed control system 10 of the present invention can be compatibly retrofit onto almost any conventional metal forming machine to incrementally advance metal stock into the die press of the metal forming machine. In FIG. 1, a conventional metal forming machine 12 is shown having a mechanical press 14 that is driven by a rotating, motorized cam drive 16. The press 14 can be fitted with any desired tool, such as a cutter, a punch, a die, or a stamper, to perform a chosen metal forming operation on wire or elongated flat strips of metal stock.

The cam drive 16 rotates 360 degrees, repeatedly cycling the press 14 up and down. The press 14 reaches its highest point at 0 or 360 degrees ("top-dead-center") and reaches its lowest point at 180 degrees, where the press 14 engages the wire or metal stock being formed. Preferably, the metal forming machine 12 includes a hand wheel 18 for manually cycling the press 14. Preferably, the cam drive 16 includes a clutch between the cam motor and the cam itself, which is disengaged when the hand wheel 18 is manually turned. By turning the hand wheel 18, the metal forming machine 12 can be walked through a metal forming operation exactly the same as an automatic operation, only slower. This allows problems to be more easily spotted and adjustments to the metal forming machine 12 more easily made.

Shown in the drawings as numeral 20, metal stock used in metal forming machine 12 is an elongated flat strip that is fed from a large supply roll or coil 22. Preferably, the metal stock 20 is fed through a straightener 24 mounted on the metal forming machine 12 before being fed into the press 14. While the bulk of this description will focus on a flat, elongated strip of metal stock 20 as an example, this is not intended to be limiting, for wire or other shapes of metal stock could just as easily be used with the feed control system 10 of the present invention.

Figure 2:
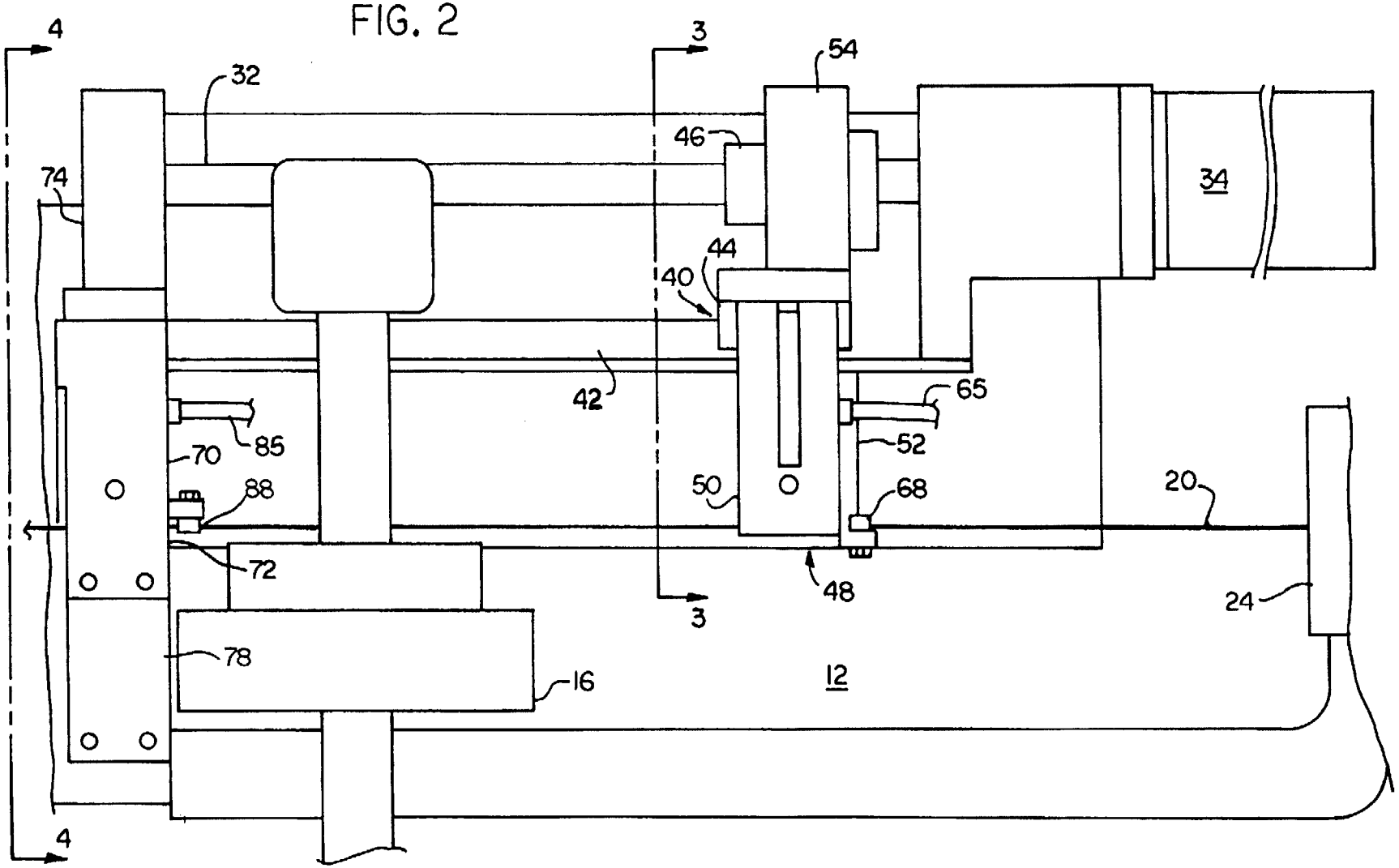
FIG. 2 is an enlarged, front elevational view of the ball-screw assembly and the feed apparatus of the feed control system.

Now turning to the feed assembly 30, FIG. 1 shows the feed assembly 30 mounted on the metal forming machine 12. It should be noted that the feed assembly 30 of the present invention is a significant improvement over conventional roller-type feed mechanisms, because the feed assembly 30 delivers significantly more torque than these conventional mechanisms with no lost motion or slipping. FIG. 2 of the drawings provides a closer, more detailed view of the feed assembly 30 and its components.

Basically, the feed assembly 30 includes three subcomponents: a ball-screw 32, a servo-motor 34, and a slide assembly 36. The feed assembly 30 can also be seen as including the gripping apparatus 40 as a fourth subcomponent; however, the gripping apparatus 40 is best described separately. The ball-screw 32 is turned by AC brushless servo-motor 34, such as a Pacific Scientific Model #R45GENA-R2-NS-NV-00. A bracket would preferably attach the end of the feed assembly 30 near the servo-motor 34 to the metal forming machine 12.

As best seen in FIG. 2, the slide assembly 36 includes an elongated rail 38 parallel to the ball-screw 32. Sliding back and forth on the rail 38 is a linear bearing 42, which is also an integral part of the gripping apparatus 40 to be described later. As seen in the end views of FIGS. 3 and 4, the rail 38 is preferably generally I-shaped so that the gripping apparatus 40 will accept loads in many directions and the linear bearing 42 cannot come off of the rail 38.

Now turning to the gripping apparatus 40, this component of the present invention engages the metal stock 20 and includes a moving roller gripper assembly 50 and a stationary roller gripper assembly 70. Preferably, the moving roller gripper assembly 50 is upstream along the travel path of the metal stock 20 from the stationary roller gripper assembly 70. The upstream, moving roller gripper assembly 50 includes a frame 52 that is connected to the feed assembly 30 both by the linear bearing 42 sliding on the slide rail and by a ball-screw drive gear 44 that encompasses the ball-screw 32. The ball-screw drive gear 44 internally engages the exterior of the ball-screw 32 to transfer rotational motion of the ball-screw 32 into linear motion of the moving roller gripper assembly 50.

Figure 3:
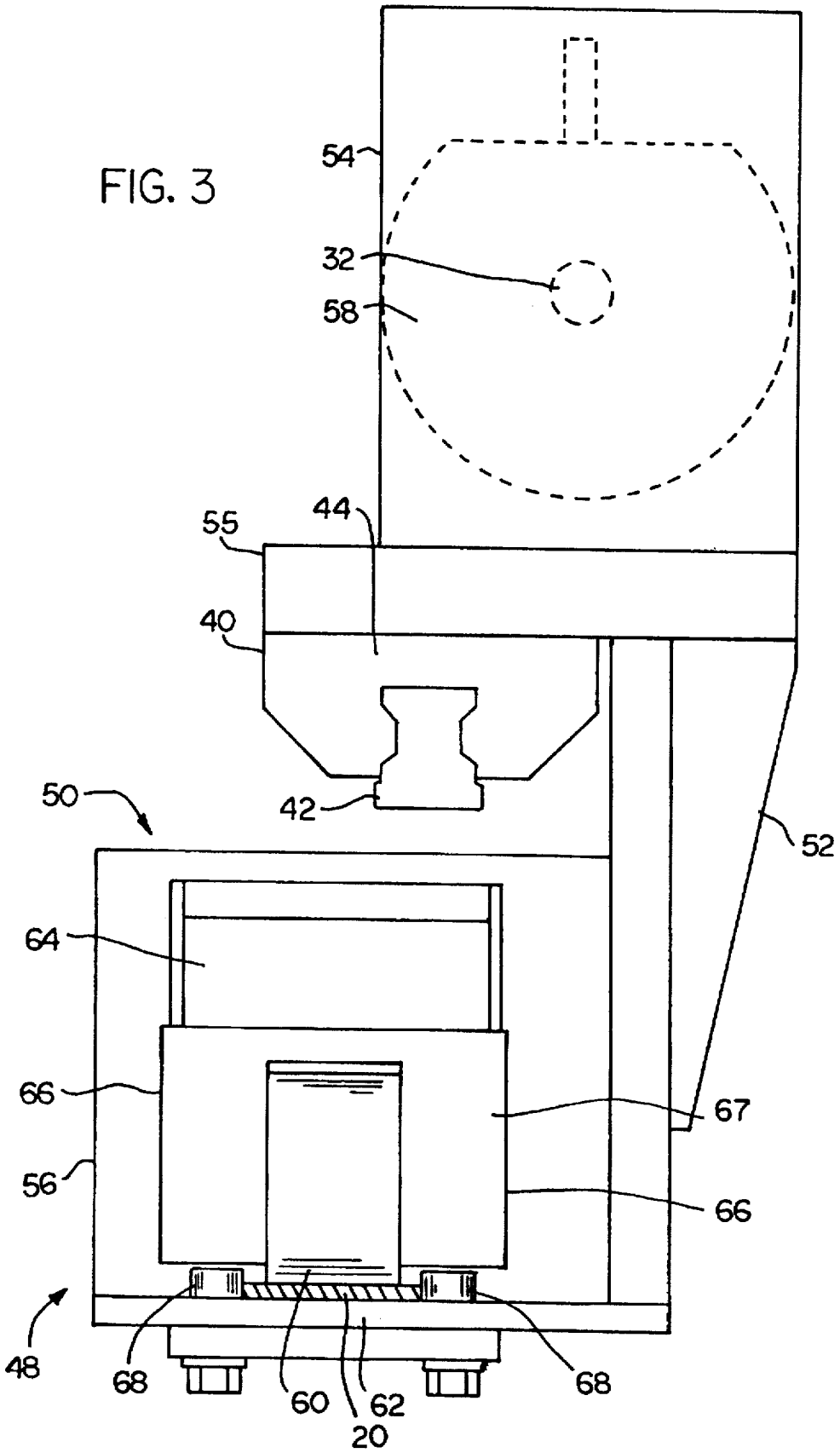
FIG. 3 is a sectional view of the moving roller gripper assembly taken along lines 3—3 of FIG. 2.

As seen in the elevational view of FIG. 3, the frame 52 of the moving roller gripper assembly 50 includes an upstanding member 54 that houses the ball screw drive gear 44, a center section 55 that is attached to the linear bearing 42, and a lower yoke 56. A roller head 60 is mounted within the yoke 56 of the frame 52, and a base plate 62 is attached to the bottom, open end of the yoke 56. An actuator 64 above the roller head 60 within the yoke 56 forces the roller head 60 downwardly towards the base plate 62 to grip the metal stock therebetween during forward strokes of the gripper assembly 50.

The roller head 60 is preferably formed of hardened steel and is preferably eccentric to enable adjustment for different thicknesses of metal stock by simply turning the roller head 60. In a preferred embodiment of the invention, the roller head 60 can be adjusted to accommodate metal stock from 0.01 inches thick to 0.135 inches thick. In the embodiment disclosed, the roller head 60 is approximately 2 inches in diameter and is 0.062 inches eccentric, which means that the axis of rotation of the roller head 60 is 0.062 inches off center. Larger degrees of eccentricity could be used, however, to allow the roller head 60 to accommodate thicker metal stock. In the drawings, the roller head 60 is shown in its uppermost adjustment position. Preferably, the roller head 60 has a treated circumferential surface to ensure good contact with the metal stock. For example, the roller head 60 may have a knurled or sandblasted surface, a urethane coating, or chrome plating.

The base plate 62 is preferably formed of hardened steel approximately 5/16th inches thick with a planar top surface. The actuator 64 is preferably a pneumatic cylinder, having an air line 65 that is connected to a pneumatic valve 90 seen in FIG. 1. Alternately, the actuator 64 could be a hydraulic pump or an electromechanical device. In the embodiment disclosed, the pneumatic cylinder actuator 64 has approximately a 2 inch bore, a 0.39 inch stroke length, and a clamping force of 213 pounds at 80 pounds per square inch of air pressure.

To enable smooth operation of the roller head 60 as it cycles up and down to grip the metal stock 20, the roller head 60 is held within an inverted U-shaped bracket 67. The actuator 64 transfers its clamping force downwardly through the top section of the U-shaped bracket 67 to the roller head 60 within. The U-shaped bracket 67 slides up and down between two friction reducing slide blocks 66 mounted in the yoke 56 of the frame 52, one slide block 66 on each side of the U-shaped bracket 67. The slide blocks 66 are preferably machined from oilite block or some other rigid, relatively low friction material.

Referring again to FIG. 2, guide rollers 68 are mounted on the frame 52 of the moving roller gripper assembly 50 adjacent the travel path of the metal stock 20 into the gripper assembly 50. Preferably approximately ½ inch wide, the guide rollers 68 guide the metal stock 20 in between the roller head 60 and the base plate 62. To accommodate different widths of metal stock 20, the guide rollers 68 are adjustable relative to each other. In the embodiment disclosed, the guide rollers 68 can be adjusted from a position almost touching each other, which would be used with thin stock, to a position approximately 1.5 inches apart. It is conceivable, however, that with a larger scale gripper assembly 50, the guide rollers 68 could be spaced even farther apart to accommodate wider metal stock 20.

Figure 4:
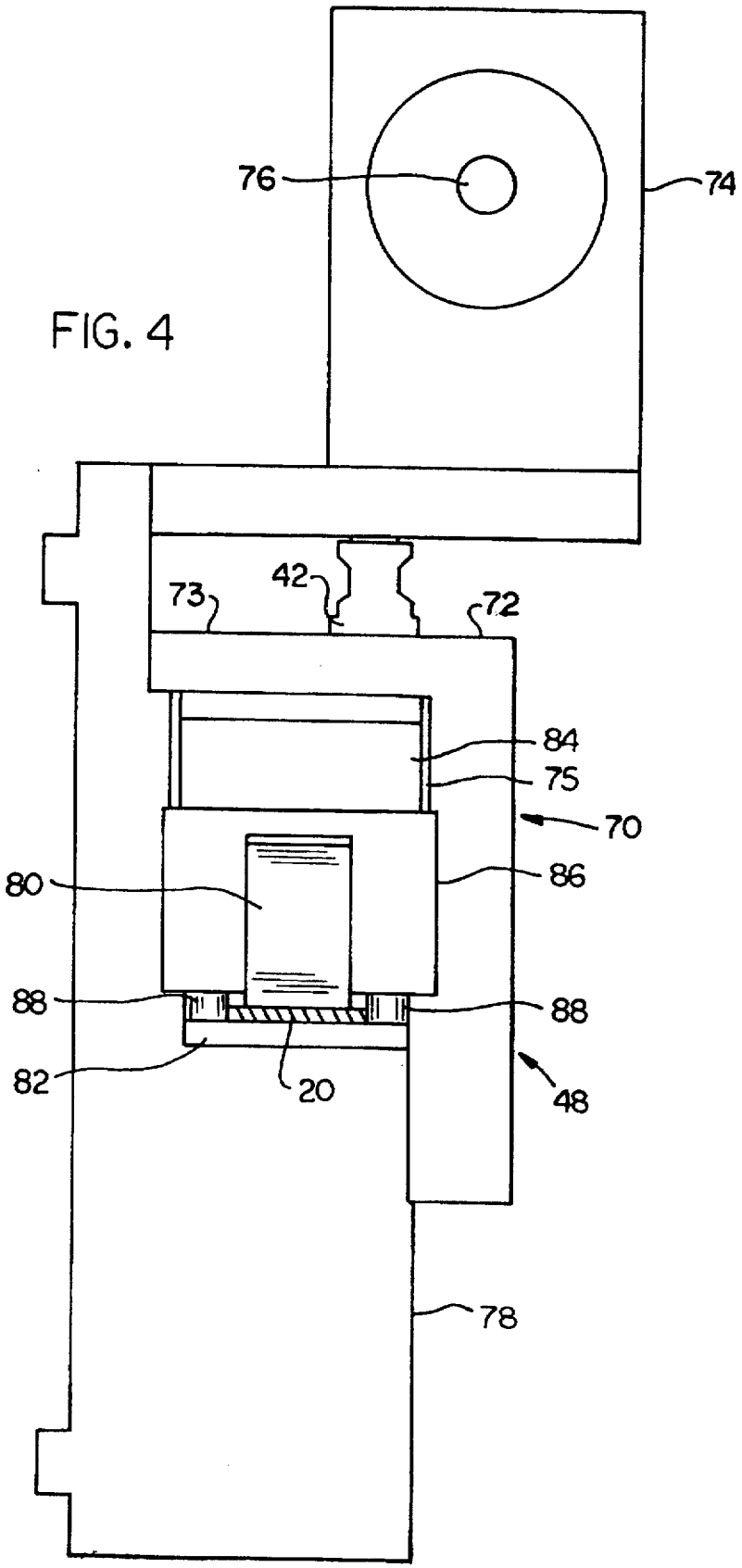
FIG. 4 is a sectional view of the stationary roller gripper assembly taken along lines 4—4 of FIG. 2.

FIG. 4 shows an elevational view of the stationary roller gripper assembly 70, which is downstream along the travel path of the metal stock 20 from the moving roller gripper assembly 50. The downstream, stationary roller gripper assembly 70 includes a frame 72 that is attached to the metal forming machine 12 by a lower mounting bracket 78. The frame 72 includes a center section 75 that corresponds to the yoke 56 of the moving roller gripper assembly 50. The frame 72 also includes an upstanding member 74 that houses a ball-screw bearing socket 76, and a rail base plate 73, which supports the I-shaped slide rail 38. The end of the ball-screw 32 opposite the servo-motor 34 is rotatably seated in the ball-screw bearing socket 76.

The components of the stationary roller gripper assembly 70 are preferably the same as those of the moving roller gripper assembly 50. Therefore, all details will not be repeated in the description of the stationary roller gripper assembly 70. It should be understood that corresponding components between the two roller gripper assemblies 50 and 70 have corresponding dimensions, functions, and specifications. A preferably eccentric roller head 80 and a base plate 82 are mounted within the center section 75 of the frame 72. The roller head 80 is held within an inverted U-shaped bracket 87. An actuator 84 is disposed overtop of the U-shaped bracket 87. Preferably, the actuator 84 is a pneumatic cylinder with an air line 85 connected to the pneumatic valve 90. As with the moving roller gripper assembly 50, the U-shaped bracket 87 slides up and down between two friction reducing slide blocks 86, which in the stationary roller gripper assembly 70 are mounted within the center section 75 of the frame 72. The stationary roller gripper assembly also includes guide rollers 88 mounted on the frame 72 adjacent the travel path of the metal stock 20.

Figure 5:
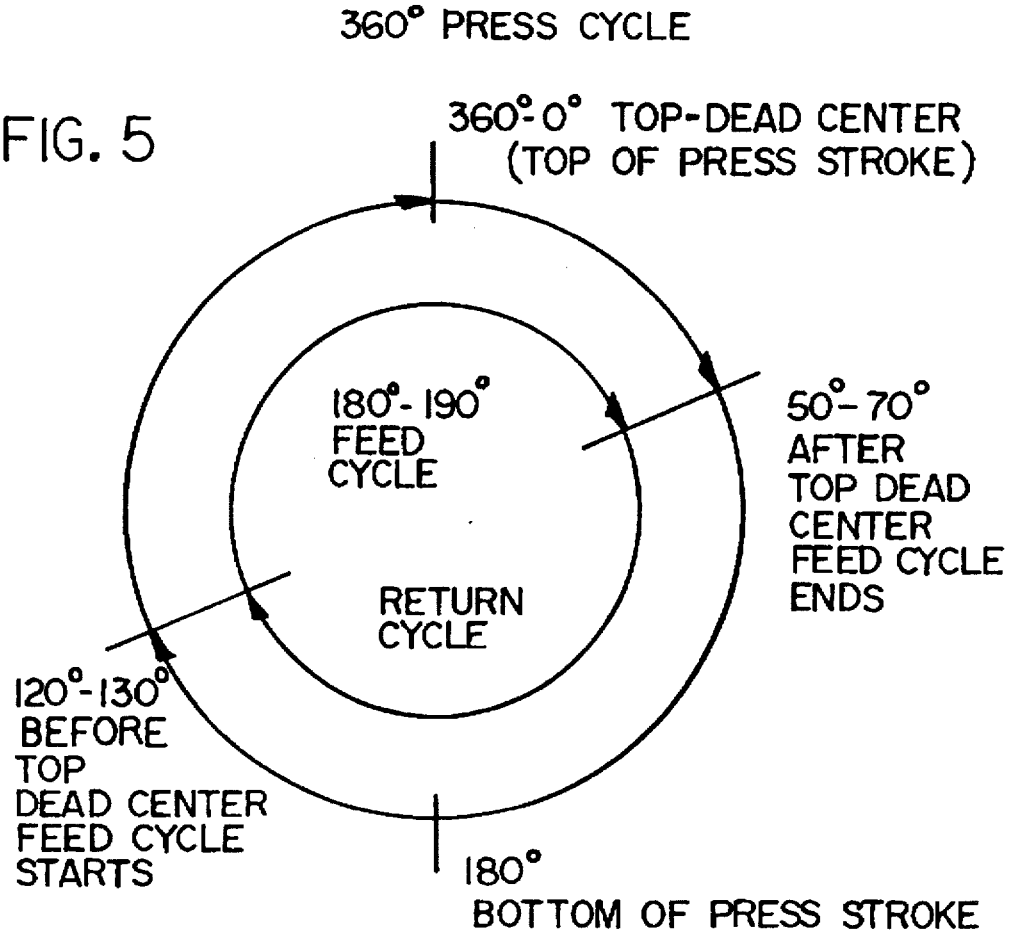
FIG. 5 is a schematic illustration of the press cycle and its relationship to the feed cycle.

To better understand the operation of the feed control system 10, it is helpful to summarize the mechanical operation of a conventional metal forming machine 12 fitted with the feed control system 10 of the present invention. Referring to FIG. 5, the cam drive 16 rotates through a 360 degree cycle to move the die press 14 in repeated up and down strokes. At 360 or 0 degrees, the cam drive 16 is at top-dead-center and the die press 14 is at the top of the press stroke. At 180 degrees, the die press 14 is at the very bottom of its stroke and is engaged with the metal stock 20. As the die press 14 cycles up away from the bottom of the stroke and is approximately 120 to 130 degrees below top-dead-center, the feed cycle starts. The timing of the initiation of the feed cycle can be varied depending on how deep the draw of the die is. For deep dies or with thick metal stock 20, the die press 14 should be closer to top-dead-center before the feed stroke starts to give the die press 14 a chance to clear the metal stock 20. The gripping apparatus 40 then feeds the metal stock 20 through the die press 14 for approximately 180 to 190 degrees of the press stroke, which translates to approximately 50 to 70 degrees after top-dead-center. The degrees of the press stroke during which the metal stock is fed into the press can be adjusted by the user of the machine. The feed control system 10 then halts the advancement of the metal stock 20 so that the stock 20 is stationary when the die press 14 cycles down and strikes the metal stock 20 again. While the stock 20 is held stationary, the gripping apparatus 40 undergoes a return cycle i preparation for advancing another length of metal stock 20 into the press 14 during a subsequent feed cycle.

Now to the operation of the feed control system 10, the gripping apparatus 40 advances the metal stock 20 by sequentially gripping it with the two roller gripper assemblies 50, 70. First, the feed cycle begins with the moving, upstream roller gripper assembly 50 in a back or home position, which is close to the servo-motor 34 and the straightener 24 and separated from the stationary, downstream roller gripper assembly 70. As the moving roller gripper assembly 50 begins moving downstream to advance the metal stock 20 toward the die press 14, the actuator 64 of the moving roller gripper assembly 50 forces the roller head 60 downwardly to securely grip the metal stock 20 against the base plate 62. At the same time, actuator 84 of the stationary roller gripper assembly 70 allows roller head 80 to rise up and away from base plate 82, thereby releasing the metal stock 20. The servo-motor 34 turns the ball-screw 32 to advance the ball-screw drive gear 44 and the attached moving roller gripper assembly 50 in the downstream direction while the gripper assembly 50 is engaging the stock 20, thereby advancing the stock 20 towards the die press 14.

When the metal stock 20 has been advanced a predetermined distance into the die press 14, the servo-motor 34 stops turning the ball-screw 32, thereby halting advancement of gripper assembly 50. After the metal stock 20 has stopped moving, the actuator 84 of the stationary roller gripper assembly 80 forces the roller head 80 downwardly to securely grip the metal stock 20 against the base plate 82. Because the stationary roller gripper assembly 80 is bolted to the metal forming machine 12 by bracket 78, the metal stock 20 cannot be moved at all at this point, during which time the press 14 stamps the stock 20. The moving roller gripper assembly 50 then releases its grip on the metal stock 20 and returns to its home position close to the servo-motor 34 and straightener 24. The moving roller gripper assembly 50 is moved by reverse rotation of the servo-motor 34, which draws the linear bearing 42 and the gripper assembly 50 upstream. After the moving roller gripper assembly 50 has returned to its home, upstream position, the feed apparatus cycle can begin again to advance another segment of metal stock 20 into the die press 14.

To use the metal forming machine 12 having the feed control system 10 of the present invention, the first step is to manually thread the metal stock 20 from the supply reel 22, through the straightener 24, and into the gripping apparatus 40. When threading the gripping apparatus 40, the actuators 64, 84 and therefore the roller heads 60, 80 are in the "up" position so that the metal stock 20 can be threaded between the roller heads 60, 80 and the base plates 62, 82, respectively. The metal stock is then threaded through the die press 14 until the stock 20 emerges from the out-feed side of the die press 14.

Figure 6:
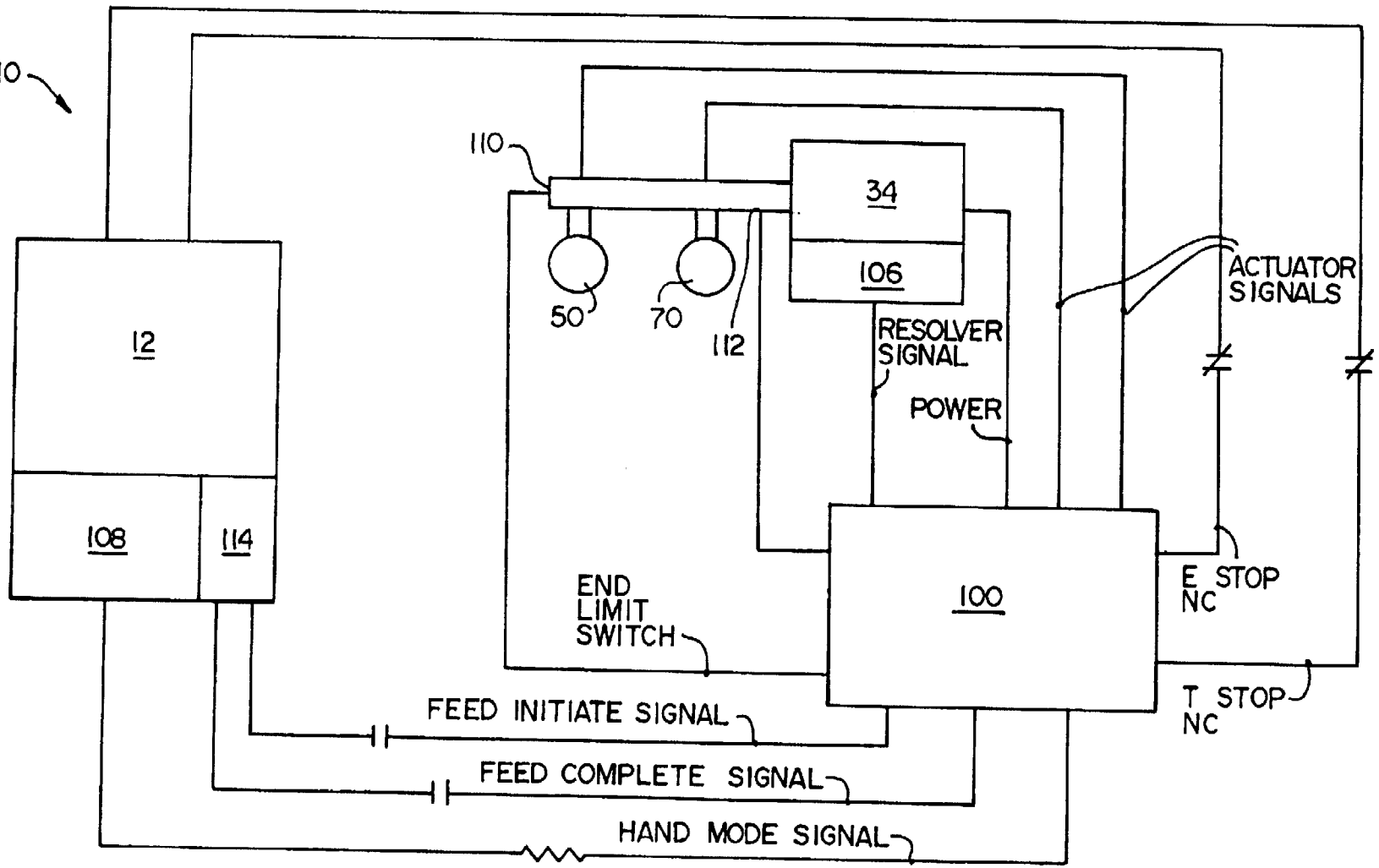
FIG. 6 is a schematic diagram of the operation of the feed control system of the present invention.

Looking now at FIGS. 6, once the metal forming machine 12 is threaded, an operator can use the microprocessor control system 100 to run the metal forming operation. The microprocessor control system 100 includes a microprocessor and a control console having a microprocessor interface and manual operator controls (not shown). The microprocessor receives input signals from various control switches and sensors and outputs signals to the metal forming machine 12, the servo-motor 34, and the pneumatic valve 90.

A resolver 106 is interconnected between the microprocessor and the servo-motor 34, preferably built into the motor casing of the servo-motor 34. The resolver 106 breaks each 360 degree rotation of the servo-motor 34 into a number of incremental steps. In the preferred embodiment, the resolver 106 breaks each turn into 4,096 steps. The resolver 106 can therefore communicate the precise rotational position of the ball-screw 32 to the microprocessor by outputting the number of increments that the servo-motor 34 has turned. As should be apparent, because the linear position of the moving roller gripper assembly 50 is dependent upon the rotational position of the ball-screw 32, the precise linear position of the moving roller gripper assembly 50 can likewise be determined. The microprocessor can thus set the moving roller gripper assembly 50 at any chosen linear position and move it according to the given requirements of a particular feed cycle by outputting power to the servo-motor 34 while monitoring the linear position of the gripper assembly 50 via the resolver 106.

However, when the feed control system 10 is first started, the microprocessor control system 100 and the resolver 106 must be initialized so that the resolver 106 can communicate the rotational position of the ball-screw 32 with reference to a known starting or home position. A first limit switch 110 is used to "zero" the moving roller gripper assembly 50 into its home position. The first limit switch 110 is operably connected to the microprocessor and is mounted on the feed assembly 30 proximate the home position of the gripper assembly 50 near the servo-motor 34. When the feed control system 10 is first started, the moving roller gripper assembly 50 seeks its home position by moving upstream until it reaches the first limit switch 110. When the gripper assembly 50 reaches this point, the first limit switch 110 signals the microprocessor to stop the servo-motor 34, thereby halting and zeroing the gripper assembly 50. Preferably, the gripper assembly 50 then moves a short predetermined distance downstream away from the limit switch 110 before the start of the feed cycle. The reason for this is that the limit switch 110 also acts as a safety cut-off to shut down the feed control system 10 in case of accidental overrun of the slide assembly 36 to prevent damage. The gripper assembly 50 therefore starts the feed cycle slightly away from the limit switch 110 so that when the gripper assembly 50 reaches the home position in the feed cycle, it will not accidentally trip the limit switch 110 and shut down the system.

A second limit switch 112, wired in series with the first limit switch 110, is mounted on the feed assembly 30 near the stationary roller gripper assembly 70 to also act as a safety cut-off in case of accidental overrun at the forward end of the feed cycle stroke. Because the microprocessor knows the linear position of the moving roller gripper assembly 50 at all times, during proper operation of the feed control system 10, the first limit switch 110 is used during initial zeroing and the second limit switch 112 is used as a safety stop to prevent damage due to a malfunction.

As stated previously, the metal forming machine 12 preferably includes a hand wheel 18, which is used to manually walk the metal forming machine 12 through a press cycle in a "hand mode." However, in the preferred embodiment, there is no mechanical linkage between the die press 14 and the feed control system 10. Therefore, the present invention provides a way of synchronizing hand mode operation of the die press 14 with the microprocessor-controlled operation of the feed control system 10. A hand mode encoder 108 allows the feed control system 10 to function during hand mode by electronically simulating a mechanical link between the press 14 and the feed assembly 30. The hand mode encoder 108 is attached to the hand wheel 18 and is operably connected to the microprocessor. The hand mode encoder 108 outputs to the microprocessor the precise position in the press cycle of the die press 14, in terms of degrees (0 to 360). The microprocessor then calculates the proper feed cycle position and speed required to synchronize the die press 14 and the feed control system 10 and then outputs this necessary information to the servo-motor 34, all the while monitoring the operation of the gripping apparatus 40 via the resolver 106. The microprocessor control system 100 thus acts as an electronic gear to link the press cycle and the feed cycle in a one-to-one relationship (during the 180–190 degrees of the press stroke) when the die press 14 is being manually driven with the hand wheel 18.

During normal operation of the metal forming machine 12 when the die press 14 is driven by the cam drive 16, the microprocessor determines when to start and stop the feed cycle in order to synchronize the feed cycle with the press cycle. The microprocessor monitors the position of the die press 14 in the press cycle by receiving two signals output from a feed control sensor 114 on the metal forming machine 12. This feed control sensor 114 may be positioned to monitor almost any moving component of the metal forming machine that moves in the press cycle, such as the cam drive 16. The feed control sensor 114 is preferably a rotary limit switch having a cam that is turned along with the cam drive 16, but it could also be some other form of a contact closure or physical relay To initiate the feed cycle, the feed control sensor 114 outputs a feed initiate signal, such as at least a 30 millisecond pulse, to the microprocessor when the cam drive 16 is at approximately 120 to 130 degrees before top-dead-center. The feed control sensor 114 also simultaneously outputs a second, feed complete signal that does not pulse, but remains on. Thus, the feed control sensor 114 outputs two signals to the microprocessor. The feed complete signal preferably remains on throughout approximately 180–190 degrees of the press cycle, which is until the press cycle has reached a position approximately 50 to 70 degrees after top-dead-center. The feed complete signal acts as a misfeed or slow feed signal if the feed cycle has not been completed and the metal stock 20 brought to a halt by the time that the feed complete signal ends. If the moving roller gripper assembly 50 is still moving downstream and advancing the metal stock 20 at the time that the feed complete signal ends, then the microprocessor determines that the feed cycle is moving too slowly because of a malfunction of the feed control system 10. If such a misfeed or slow feed, occurs, the microprocessor stops the die press 14 to prevent any possibly damage to the die press 14 or the feed control system 10 caused by the die press 14 stamping the metal stock 20 while the stock 20 is still moving.

The microprocessor interface on the control console includes a keypad and a display. The manual operator controls on the console include a main power switch, a "feed ready" start button and an emergency stop button. The interface allows an operator to set feed cycle parameters, such as feed length and feed speed, while walking an operator through the initial start-up of the feed control mechanism 10. In the preferred embodiment, the feed length can be adjusted in 0.001" increments. Also in the preferred embodiment, the feed speed is adjustable. The microprocessor includes a memory storage database so that an operator can store the parameters for a particular metal forming job, naming the stored parameters as a part number. Then, the next time that particular part is to be formed, the feed control system 10 will not need to be reset and reprogrammed. Rather, the stored parameters can be looked up by the part number of the particular part to be formed, and the feed control system 10 will automatically operate using the same parameters that were saved from the previous job.

After the machine has been threaded, but before a metal forming operation has begun, the operator can use the interface to verify that the selected feed length is correct and the selected speed is correct. Pressing the "feed ready" start button then activates the feed control system 10 and the metal forming machine 12. At any time, the operator can call up a functions menu on the display of the interface and change a parameter. The operator can verify that the metal forming operation is proceeding properly and, if not, make slight changes, such as by changing the feed length. Once the operator has verified that all the parameters are correct, the operator can save the currently running job as a part number so that the next time it is run, there will be no need to reprogram the feed control system 10. The top-dead-center stop button 136 is provided so that the die press 14 can be stopped at precisely the top-dead-center position of the press cycle. The emergency stop button allows the machine to be stopped quickly in case of imminent danger to the machine or operator.

Certain modifications and improvements will occur to those skilled in the art upon a reading of the foregoing description. It should be understood that all such modifications and improvements have been deleted herein for the sake of conciseness and readability but are properly within the scope of the following claims.

We claim:

1. A control system for a metal forming machine having a cycling press and a cycling stock feeding mechanism, the stock feeding mechanism including a motor-driven screw assembly and a feed apparatus that is linearly movable in response to rotation of the screw assembly for engaging and feeding stock into the cycling press, said control system comprising:

(a) a microprocessor for controlling cycling of the feed apparatus and for synchronizing the cycling of the feed apparatus with the cycling of the press;

(b) a resolver interconnected between said screw assembly and said microprocessor for monitoring rotational position of the screw assembly and for communicating the rotational position of the screw assembly to said microprocessor;

(c) a feed control sensor interconnected between said press and said microprocessor for communicating the position of the press in a press cycle to said microprocessor; and (d) wherein the metal forming machine includes a hand wheel for manually cycling the press, and said microprocessor includes a hand mode encoder operatively connected to said hand wheel for determining the position of the press in a manually driven press cycle.

2. The apparatus according to claim 1, further including a limit switch for establishing an initial zero rotational position of the screw assembly.

3. The apparatus according to claim 1, wherein said resolver divides each rotation of said screw assembly into predetermined increments.

4. The apparatus according to claim 1, wherein the microprocessor includes means for shutting down the metal forming machine in response to a misfeed signal from the feed control sensor.

5. The apparatus according to claim 1, wherein the microprocessor includes means for stopping the press at a top-dead-center point of a press cycle.

6. The apparatus according to claim 1, wherein said microprocessor includes an electronic gear for linking the hand mode encoder to the resolver, thereby synchronizing operation of said screw assembly with manual operation of the press.

7. The apparatus according to claim 6, wherein the hand mode encoder and the resolver are linked in a 1:1 gear relationship.

8. The apparatus according to claim 1, further including a control console having a microprocessor interface for inputting feed cycle parameters of a metal forming operation.

9. The apparatus according to claim 1, wherein the microprocessor includes a database for storing feed cycle parameters of a plurality of metal forming operations.

10. A feed control system for feeding metal stock into a press of a metal forming machine, said feed control system comprising:

(a) a feed assembly mounted on said metal forming machine and including: (i) a slide assembly, (ii) a rotating ball-screw operatively connected to said slide assembly, said slide assembly linearly movable in response to rotation of said ball-screw, and (iii) a servo-motor for driving said ball-screw; and (b) a control system operatively connected to said feed assembly for automatically cycling said press and said feed assembly in synchronization with each other to feed said metal stock into said press, said control system including: (i) a microprocessor for controlling cycling of the feed apparatus and for synchronizing the cycling of the feed apparatus with the cycling of the press; (ii) a resolver interconnected between said ball-screw and said microprocessor for monitoring rotational position of the ball-screw and for communicating the rotational position of the ball-screw to said microprocessor; and (iii) a feed control sensor interconnected between said press and said microprocessor for communicating the position of the press in a press cycle to said microprocessor;

(c) a gripping apparatus attached to said slide assembly for engaging and moving the metal stock into the press, wherein said gripping apparatus includes a roller gripper assembly including a roller head, an actuator, and a base plate mounted in a frame, said actuator adapted for moving said roller head towards said base plate to grip the metal stock therebetween; and (d) wherein the metal forming machine includes a hand wheel for manually cycling the press, and said microprocessor includes a hand mode encoder operatively connected to said hand wheel for determining the position of the press in a manually driven press cycle.

11. The apparatus according to claim 10, wherein said roller gripper assembly includes a ball-screw drive gear that engages said ball-screw, said ball-screw drive gear for transferring rotational movement of said ball-screw into linear movement of said roller gripper assembly.

12. The apparatus according to claim 10, wherein said roller head is disposed within a U-shaped bracket.

13. The apparatus according to claim 12, wherein said roller gripper assembly further includes a pair of friction reducing slide blocks mounted in said frame, one slide block on each side of said U-shaped bracket.

14. The apparatus according to claim 12, wherein said roller gripper assembly further includes a pair of guide rollers for guiding the metal stock in between said roller head and said base plate.

15. The apparatus according to claim 14, wherein said guide rollers are adjustable relative to each other.

16. The apparatus according to claim 10, wherein said base plate is formed of hardened steel.

17. The apparatus according to claim 10, wherein said roller head is eccentric.

18. The apparatus according to claim 10, wherein said roller head is formed of hardened steel.

19. The apparatus according to claim 10, wherein said actuator includes a pneumatic cylinder.

20. The apparatus according to claim 10, wherein said feed apparatus further includes a second roller gripper assembly.

21. The apparatus according to claim 20, wherein said first and second roller gripper assemblies sequentially engage the metal stock to incrementally advance the metal stock towards the press.

22. The apparatus according to claim 21, wherein said second roller gripper assembly includes a roller head and base plate for gripping the metal stock therebetween.

23. The apparatus according to claim 22, wherein said second roller gripper assembly further includes an actuator for moving said roller head towards said base plate.

24. The apparatus according to claim 22, wherein said roller head is formed of hardened steel.

25. The apparatus according to claim 22, wherein said base plate is formed of hardened steel.

26. The apparatus according to claim 22, wherein said roller head is eccentric.

27. The apparatus according to claim 20, wherein said second roller gripper assembly includes a mounting bracket for stationary attachment to the metal forming machine.

28. The apparatus according to claim 27, wherein said second roller gripper assembly includes a ball-screw bearing socket, one end of said ball-screw rotatably seated in said ball-screw bearing socket.

29. The apparatus according to claim 10, wherein said metal forming machine includes a hand wheel for manually cycling said press.

30. The apparatus according to claim 10, further including a straightener mounted on said metal forming machine for straightening the metal stock and for feeding the metal stock into said feed apparatus.

31. The apparatus according to claim 10, wherein said servo-motor is brushless.

32. The apparatus according to claim 10, wherein said slide assembly includes an elongated rail parallel to said ball-screw.

33. The apparatus according to claim 32, wherein said slide assembly further includes a linear bearing for sliding on said elongated rail.

34. The apparatus according to claim 10, further including a limit switch for establishing an initial zero rotational position of the screw assembly.

35. The apparatus according to claim 10, wherein said resolver divides each rotation of said screw assembly into predetermined increments.

36. The apparatus according to claim 10, wherein the microprocessor includes means for shutting down the metal forming machine in response to a misfeed signal from the feed control sensor.

37. The apparatus according to claim 10, wherein the microprocessor includes means for stopping the press at a top-dead-center point of a press cycle.

38. The apparatus according to claim 36, wherein said microprocessor includes an electronic gear for linking the hand mode encoder to the resolver, thereby synchronizing operation of said screw assembly with manual operation of the press.

39. The apparatus according to claim 38, wherein the hand mode encoder and the resolver are linked in a 1:1 gear relationship.

40. The apparatus according to claim 10, further including a control console having a microprocessor interface for inputting feed cycle parameters of a metal forming operation.

41. The apparatus according to claim 10, wherein the microprocessor includes a database for storing feed cycle parameters of a plurality of metal forming operations.

* * * * *

UNITED STATES PATENT AND TRADEMARK OFFICE

CERTIFICATE OF CORRECTION

PATENT NO. : 5,699,688

DATED : December 23, 1997

INVENTOR(S) : Robert T. Allred

It is certified that error appears in the above-identified patent and that said Letters Patent is hereby corrected as shown below:

Column 12, line 49, "claim 36," should read --Claim 10--

Signed and Sealed this

Twenty-eighth Day of April, 1998

Bruce Lehman

*Attest:*

BRUCE LEHMAN

*Attesting Officer*

*Commissioner of Patents and Trademarks*